US005593277A

United States Patent [19]

Proctor et al.

[11] Patent Number: 5,593,277

[45] Date of Patent: Jan. 14, 1997

[54] SMART TURBINE SHROUD

[75] Inventors: Robert Proctor, West Chester; David R. Linger, Cincinnati; David A. Di Salle, West Chester; Steven R. Brassfield, Cincinnati; Larry W. Plemmons, Fairfield, all of Ohio

[73] Assignee: General Electric Company, Cincinnati, Ohio

[21] Appl. No.: 467,418

[22] Filed: Jun. 6, 1995

[51] Int. Cl.[6] ..... F01D 11/18

[52] U.S. Cl. ..... 415/173.1; 415/115

[58] Field of Search ..... 415/173.1, 138, 415/115

[56] References Cited

U.S. PATENT DOCUMENTS

| | | | |
|---|---|---|---|
| 4,101,242 | 7/1978 | Coplin et al. . | |
| 4,303,371 | 12/1981 | Eckert . | |
| 4,573,866 | 3/1986 | Sandy, Jr. et al. . | |
| 5,080,557 | 1/1992 | Berger | 415/115 |
| 5,169,287 | 12/1992 | Proctor et al. . | |
| 5,174,714 | 12/1992 | Plemmons et al. . | |
| 5,273,396 | 12/1993 | Albrecht et al. | 415/173.1 |
| 5,330,321 | 7/1994 | Roberts et al. | 415/138 |

OTHER PUBLICATIONS

General Electric Company, CF34–3A1 gas turbine engine in production more than 1 year; 3 figures showing high pressure turbine shrouds and unpublished proposed temporary fix.

*Primary Examiner*—F. Daniel Lopez
*Assistant Examiner*—Michael S. Lee
*Attorney, Agent, or Firm*—Andrew C. Hess; Wayne O. Traynham

[57] ABSTRACT

A turbine shroud includes an annular outer casing having first and second radial flanges between which are suspended an adjoining annular shroud support and an annular shroud hanger. A plurality of shroud panels are joined to the shroud hanger and are positionable radially above turbine rotor blades to define a tip clearance therebetween. The four flanges are disposed in abutting contact with each other, and respective pluralities of circumferentially spaced apart first, second, and third recesses are disposed respectively between the casing first flange and the shroud flange, between the shroud flange and the hanger flange, and between the hanger flange and the casing second flange for providing radial flowpaths therebetween. The support flange and the hanger flange have respective pluralities of circumferentially spaced apart first and second metering holes extending axially therethrough for providing flow communication between the first, second, and third recesses for channeling compressor bleed air therethrough for controlling the tip clearance.

10 Claims, 4 Drawing Sheets

SMART TURBINE SHROUD

CROSS REFERENCE TO RELATED APPLICATION

The present invention is related to concurrently filed application Ser. No. 08/467,436, filed Jun. 6, 1995, entitled "Turbine Shroud Hanger".

BACKGROUND OF THE INVENTION

The present invention relates generally to gas turbine engines, and, more specifically, to clearance control between turbine rotor blade tips and a stator shroud spaced radially thereabove.

A gas turbine engine includes in serial flow communication one or more compressors followed in turn by a combustor and high and low pressure turbines disposed axisymmetrically about a longitudinal axial centerline within an annular outer casing. During operation, the compressors are driven by the turbine and compress air which is mixed with fuel and ignited in the combustor for generating hot combustion gases. The combustion gases flow downstream through the high and low pressure turbines which extract energy therefrom for driving the compressors and producing output power either as shaft power or thrust for powering an aircraft in flight, for example.

Each of the turbines includes one or more stages of rotor blades extending radially outwardly from respective rotor disks, with the blade tips being disposed closely adjacent to a turbine shroud supported from the casing. The tip clearance defined between the shroud and blade tips should be made as small as possible since the combustion gases flowing therethrough bypass the turbine blades and therefore provide no useful work. In practice, however, the tip clearance is typically sized larger than desirable since the rotor blades and turbine shroud expand and contract at different rates during the various operating modes of the engine.

The turbine shroud has substantially less mass than that of the rotor blades and disk and therefore responds at a greater rate of expansion and contraction due to temperature differences experienced during operation. Since the turbines are bathed in hot combustion gases during operation, they are typically cooled using compressor bleed air suitably channeled thereto. In an aircraft gas turbine engine for example, acceleration burst of the engine during takeoff provides compressor bleed air which is actually hotter than the metal temperature of the turbine shroud. Accordingly, the turbine shroud grows radially outwardly at a faster rate than that of the turbine blades which increases the tip clearance and in turn decreases engine efficiency. During a deceleration chop of the engine, the opposite occurs with the turbine shroud receiving compressor bleed air which is Cooler than its metal temperature causing the turbine shroud to contract relatively quickly as compared to the turbine blades, which reduces the tip clearance.

Accordingly, the tip clearance is typically sized to ensure a minimum tip clearance during deceleration, for example, for preventing or reducing the likelihood of undesirable rubbing of the blade tips against the turbine shrouds.

The turbine shroud therefore directly affects overall efficiency or performance of the gas turbine engine due to the size of the tip clearance. The turbine shroud additionally affects performance of the engine since any compressor bleed air used for cooling the turbine shroud is therefore not used during the combustion process or the work expansion process by the turbine blades and is unavailable for producing useful work. Accordingly, it is desirable to reduce the amount of bleed air used in cooling the turbine shroud for maximizing the overall efficiency of the engine.

In order to better control turbine blade tip clearances, active clearance control systems are known in the art and are relatively complex for varying during operation the amount of compressor bleed air channeled to the turbine shroud. In this way the bleed air may be provided as required for minimizing the tip clearances, and the amount of bleed air may therefore be reduced.

However, in order to minimize the complexity and cost of providing clearance control, typical turbine shrouds are unregulated in cooling the various components thereof. In one conventional design for example, a row of turbine shroud panels is suspended from forward and aft legs of a shroud hanger also having a radial hanger flange extending outwardly. The forward leg of the shroud hanger is itself supported in a complementary forward leg of an annular shroud support which itself has a radial support flange extending outwardly and adjoining the hanger flange. Both the hanger flange and the support flange are sandwiched between a pair of radial casing flanges along an axial splitline of the casing. A plurality of bolts are circumferentially spaced apart around the casing and extend through these four adjoining flanges for tightly clamping them together.

In this prior art turbine shroud arrangement, an annular groove or slot is formed in the forward face of the hanger flange for receiving bleed air, and another slot is formed in the aft face of the hanger flange for discharging the bleed air, with through-holes extending axially through the hanger flange for providing flow communication therebetween. In this way, both sides of the hanger flange are bathed in bleed air. However, the corresponding slots communicate with the annular bolt line of the several bolts, which provides undesirable leakage flow paths directly to the bolt holes which decreases efficiency. Also in this design, conventional impingement baffles are used over the shroud support forward leg and over the backside of the shroud panels and are suitably provided with the bleed air for effecting impingement cooling of these components.

SUMMARY OF THE INVENTION

A turbine shroud includes an annular outer casing having first and second radial flanges between which are suspended an adjoining annular shroud support and an annular shroud hanger. A plurality of shroud panels are joined to the shroud hanger and are positionable radially above turbine rotor blades to define a tip clearance therebetween. The four flanges are disposed in abutting contact with each other, and respective pluralities of circumferentially spaced apart first, second, and third recesses are disposed respectively between the casing first flange and the shroud support flange, between the shroud support flange and the hanger flange, and between the hanger flange and the casing second flange for providing radial flowpaths therebetween. The shroud support flange and the hanger flange have respective pluralities of circumferentially spaced apart first and second metering holes extending axially therethrough for providing flow communication between the first, second, and third recesses for channeling compressor bleed air therethrough for controlling the tip clearance.

BRIEF DESCRIPTION OF THE DRAWING

The invention, in accordance with preferred and exemplary embodiments, together with further objects and advantages thereof, is more particularly described in the following detailed description taken in conjunction with the accompanying drawings in which.

DESCRIPTION OF THE PREFERRED EMBODIMENT(S)

Figure 1:
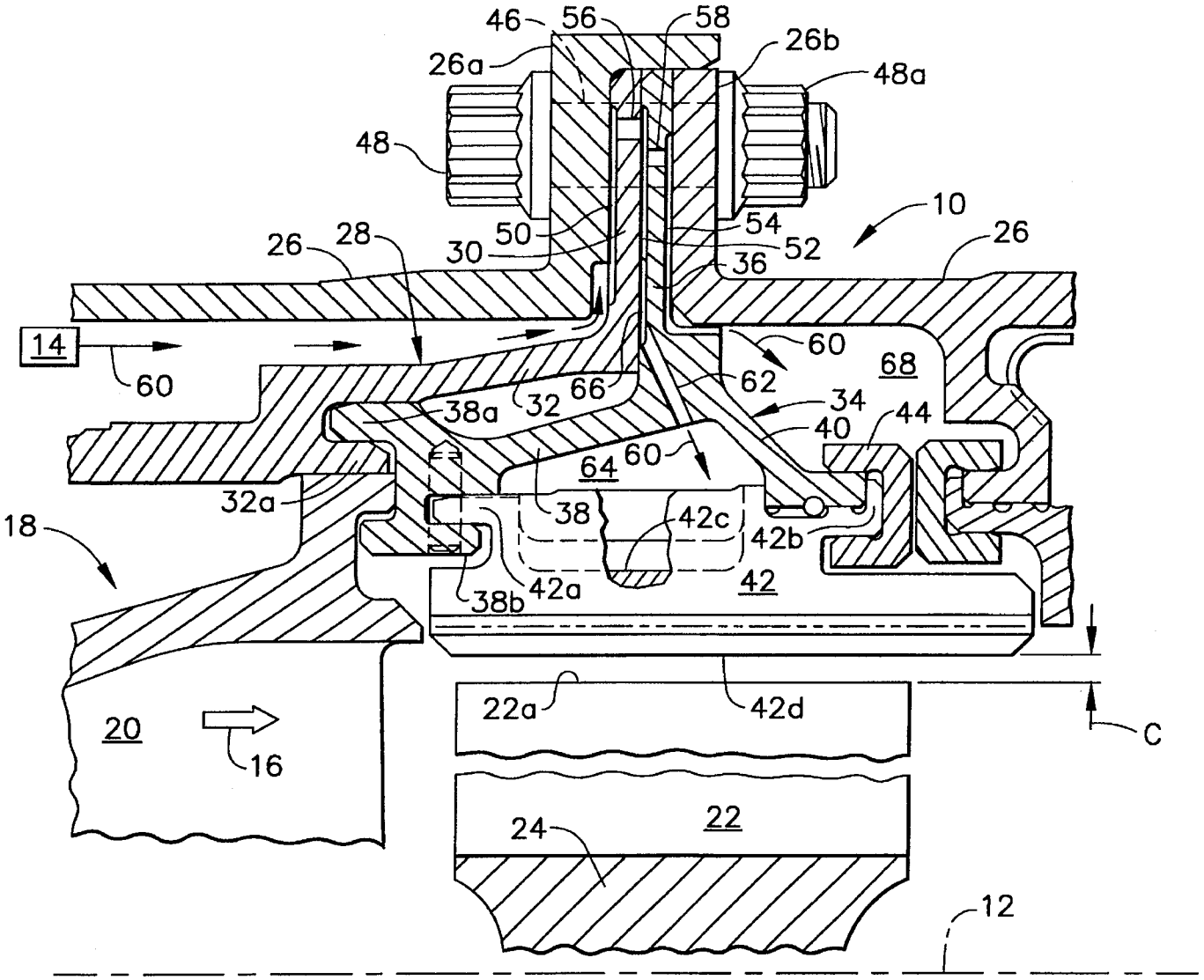
FIG. 1 is a partly sectional axial view through a portion of an axisymmetrical turbine shroud in accordance with one embodiment of the present invention surrounding a row of turbine rotor blades extending outwardly from a rotor disk.

Illustrated in FIG. 1 is an exemplary embodiment of a turbine shroud 10 which is axisymmetrical about an axial centerline axis 12 in an aircraft gas turbine engine. The aircraft engine also includes one or more conventional compressors one of which is represented schematically by the box 14, with compressed air being channeled to a conventional combustor (not shown) in which the air is mixed with fuel and ignited for generating hot combustion gases 16 which are discharged axially therefrom.

Disposed downstream from the combustor is a conventional high pressure turbine (HPT) 18 which receives the combustion gases 16 for extracting energy therefrom. In this exemplary embodiment, the HPT 18 includes at least two stages, with the first stage not being illustrated, and portions of the second stage being illustrated in FIG. 1. The second stage includes a conventional second stage stationary turbine nozzle 20 having a plurality of circumferentially spaced apart stator vanes extending radially between outer and inner annular bands. Disposed downstream from the nozzle 20 are a plurality of circumferentially spaced apart second stage turbine rotor blades 22 extending radially outwardly from a second stage rotor disk 24 axisymmetrically around the centerline axis 12.

The turbine shroud 10 illustrated in FIG. 1 is an assembly including a corresponding portion of an annular outer stator casing 26 which provides a stationary support for the several components thereof. The outer casing 26 is axially split at a pair of adjacent first and second radial flanges 26*a* and 26*b* which complement each other and are formed as respective integral ends of the casing 26 at the splitline. An annular, one-piece shroud ring or support 28 is suspended from the casing first and second flanges 26*a,b*. The shroud support 28 is generally L-shaped in transverse section and has an annular radial support flange 30 and an integral annular forward support leg 32 which extends axially forwardly from a radially inner end of the support flange 30. The forward support leg 32 extends further axially forwardly for additionally supporting the first stage turbine shroud (not shown) which is not the subject of the present invention.

An annular, one-piece shroud ring or hanger 34 is also suspended from the casing first and second flanges 26*a,b* and is disposed with the shroud support 28 coaxially about the centerline axis 12. The shroud hanger 34 is generally Y-shaped in transverse section and has an annular radial hanger flange 36, and integral annular forward and aft hanger legs 38, 40 at a radially inner end thereof. The forward and aft legs 38, 40 extend axially oppositely to each other, with the forward leg 38 having a first hook 38*a* being conventionally supported on a corresponding first hook 32*a* of the forward support leg 32.

A plurality of arcuate shroud panels 42 are conventionally removably fixedly joined to the hanger legs 38, 40 by corresponding forward and aft hooks 42*a* and 42*b*. The panel forward hook 42*a* is simply disposed on a corresponding second hook 38*b* of the forward leg 38, with the panel aft hook 42*b* being joined to the aft leg 40 by a conventional C-clip 44.

Each of the shroud panels 42 has an outer surface 42*c* which faces radially outwardly towards the bottom surface of the shroud hanger 34. Each panel 42 also includes a radially inner surface 42*d* which is positionable radially above tips 22*a* of the rotor blades 22 to define a tip clearance C therebetween.

The support flange 30 and the hanger flange 36 are axially positioned or sandwiched between the first and second casing flanges 26*a,b* in abutting or sealing contact with each other, with all four flanges 26*a*, 30, 36, and 26*b* having a plurality of circumferentially spaced apart, axially extending common or aligned bolt holes 46 (shown in dashed line in FIG. 1). The bolt holes 46 are arranged on a common radius, i.e. circumferentially extending bolt line, with each bolt hole 46 receiving a respective bolt 48 (and complementary nut 48*a*) for axially clamping together the four flanges to support the shroud panels 42 from the casing 26.

Figure 2:
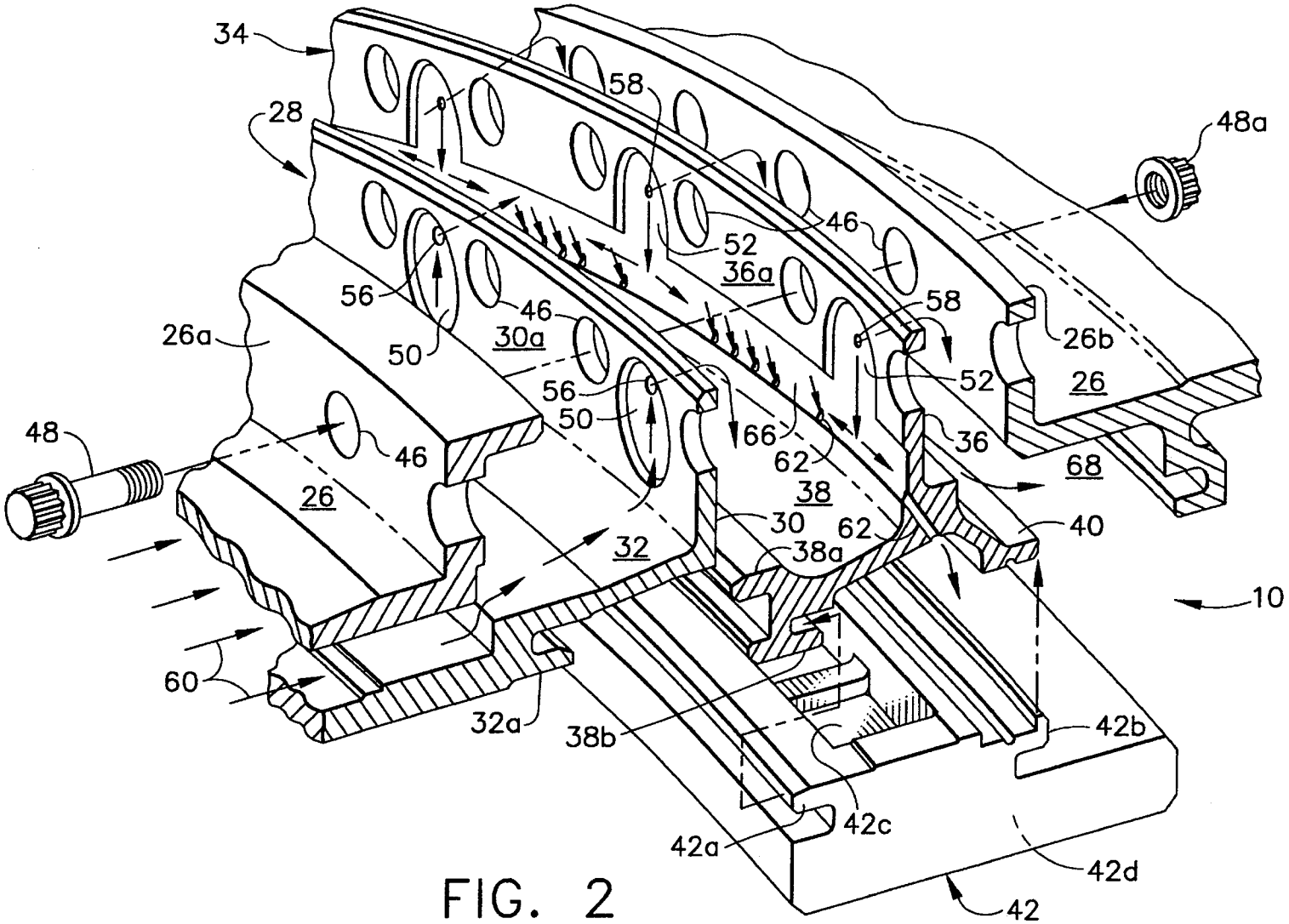
FIG. 2 is an exploded, forward facing aft perspective view of a portion of the turbine shroud illustrated in FIG. 1.
Figure 3:
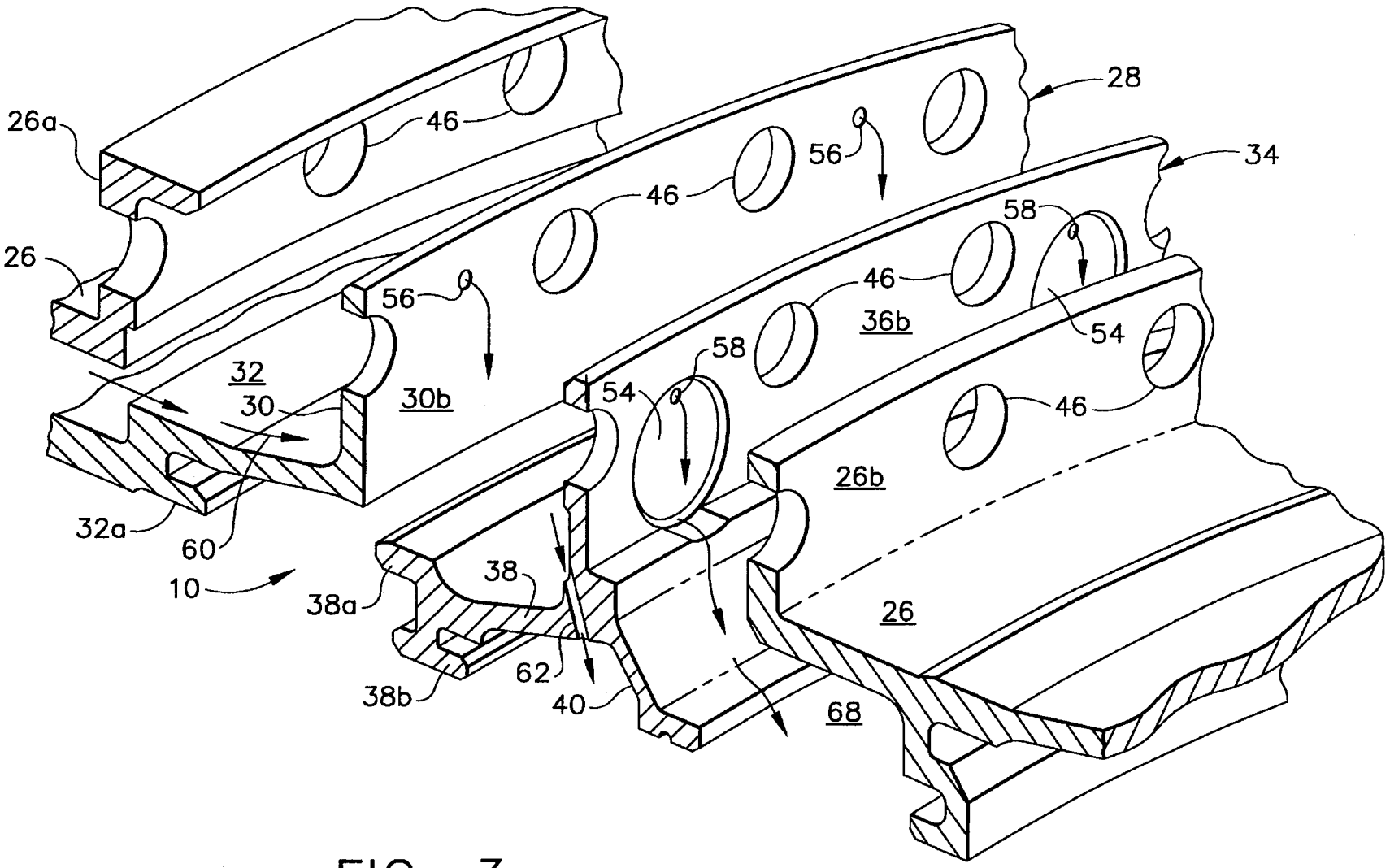
FIG. 3 is an exploded, aft facing forward perspective view of a portion of the turbine shroud illustrated in FIG. 1.

The turbine shroud assembly 10 is illustrated in more particularity in the exploded views of FIGS. 2 and 3. The four flanges 26*a*, 30, 36, and 26*b* include pluralities of circumferentially spaced apart first, second, and third recesses 50, 52, and 54 disposed respectively between the casing first flange 26*a* and the support flange 30, between the support flange 30 and the hanger flange 36, and between the hanger flange 36 and the casing second flange 26*b* for providing radial flowpaths between the adjoining flanges.

The support flange 30 and the hanger flange 36 have respective pluralities of circumferentially spaced apart first and second metering holes 56, 58 extending axially therethrough for providing flow communication between the first, second, and third recesses 50, 52, 54 for channeling compressor bleed air 60 received from the compressor 14 and channeled through the recesses for controlling the tip clearance C shown in FIG. 1. As shown in FIGS. 2 and 3, the first, second, and third recesses 50, 52, and 54 are preferably circumferentially spaced from the bolt holes 46 for preventing flow communication therebetween and reducing any likelihood of leakage therethrough.

More specifically, the support flange 30 further includes a flat forward surface or face 30*a* which when assembled to the casing first flange 26*a* is disposed in abutting, sealed contact with the aft face thereof. The first recesses 50 provide a radial flowpath outwardly from above the forward support leg 32 for channeling the compressor bleed air 60 to the first metering holes 56 which extend axially through respective ones of the first recesses 50.

As shown in FIG. 2, the hanger flange 36 further includes a preferably flat forward face 36*a* which is disposed in abutting, sealed contact with a preferably flat aft face 30*b* of the support flange 30 shown exploded in FIG. 3 and assembled in FIG. 1. The hanger flange forward face 36*a* as shown in FIG. 2 preferably includes the second recesses 52 disposed in flow communication with respective ones of the first metering holes 56 as shown in FIG. 1 for providing a radial flowpath inwardly between the support flange 30 and the hanger flange 36. The second metering holes 58 extend axially through the hanger flange 36 in respective ones of the second recesses 52 as illustrated in FIG. 2.

As shown in FIG. 3, the hanger flange 36 further includes a preferably flat aft face 36*b* disposed in abutting sealed contact with a corresponding, preferably flat forward face of the casing second flange 26*b*, with the aft face 36*b* including the third recesses 54 therein disposed in flow communication with respective ones of the second metering holes 58 for providing a radial flowpath inwardly between the hanger flange 36 and the casing second flange 26*b*.

Figure 4:
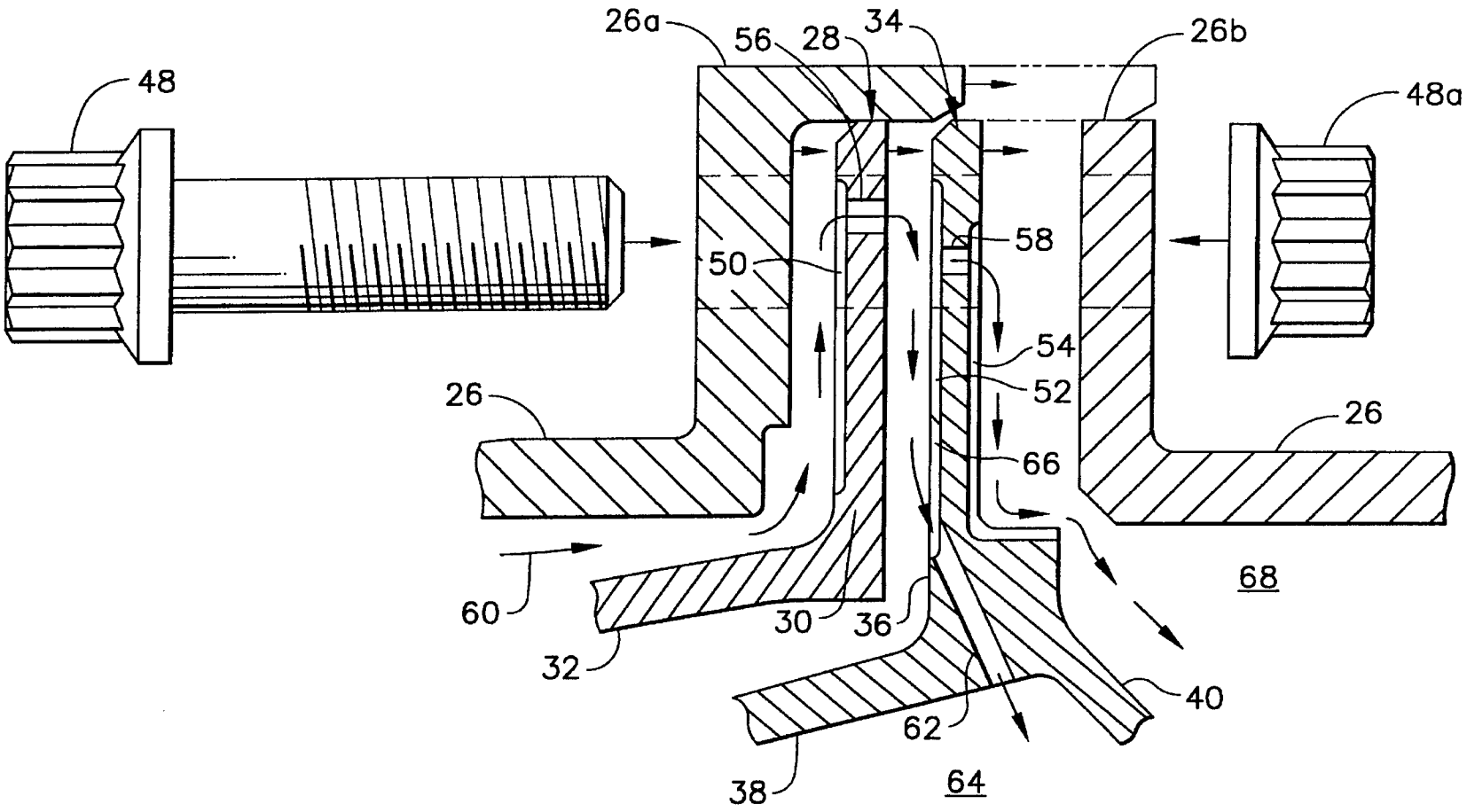
FIG. 4 is an axially exploded, elevational sectional view of the four flange joint at the top of the turbine shroud illustrated in FIG. 1.

FIG. 1 illustrates the four flanges clamped together upon assembly thereof, with FIG. 4 illustrating the four flanges exploded axially to better view the resulting flowpaths for the bleed air 60. When the flanges are assembled together and clamped by the bolts 48, the flat adjoining faces therebetween provide effective seals for eliminating or reducing leakage of the bleed air 60 therefrom. However, in order to effectively cool or heat, as the case may be, the shroud support 28 and the shroud hanger 34 for controlling the tip clearance C, the first, second, and third recesses 50, 52, 54 and the first and second metering holes 56, 58 provide serpentine flowpaths at selected circumferential portions of both forward and aft sides of the support and hanger flanges 30, 36. The bleed air 60 enters the bottom of the first recesses 50 as illustrated in FIG. 4 and flows radially upwardly and then axially through the first metering holes 56. The bleed air 60 is then divided and flows radially downwardly through the second recesses 52 and axially aft through the second metering holes 58. From the second metering holes 58, the bleed air 60 flows radially downwardly through the third recesses 54 and is discharged at the base of the hanger flange 36 above the hanger aft leg 40 and below the casing 26.

In this way, effective heating and cooling of the support and hanger flanges 30, 36 may be achieved without undesirable leakage through the bolt holes 46 which would otherwise reduce efficiency of both the clearance control system and the engine itself. It is noted that both the support and hanger flanges 30, 36 are full 360° rings which significantly affect the radial position of the shroud panels 42 suspended therefrom, which in turn affects the tip clearance C. By bathing the support and hanger flanges 30, 36 with the bleed air 60 on both forward and aft sides thereof, improved thermal response time of these flanges will be obtained with more uniform heat transfer axially therethrough. It should be noted in the embodiment illustrated in FIG. 1 that the shroud hanger 34 is generally Y-shaped and supported in large part by the hanger flange 36. The shroud hanger 34 is therefore subject to axial rocking movement thereof due to differential thermal response of the forward and aft faces of the hanger flange 36. By providing the second and third recesses 52, 54 on both sides of the hanger flange 36, axial differential thermal response will be reduced, which in turn reduces any resulting rocking movement thereof.

As shown in FIG. 4, for example, the first and third recesses 50, 54 preferably extend in lower part radially below the casing first and second flanges 26*a,b*, respectively, for receiving the bleed air 60 from above the shroud support forward leg 32 and discharging the bleed air 60 above the hanger aft leg 40. In this way, substantially full radial coverage of the bleed air 60 may be obtained. And, in the circumferential direction, a suitable number of the recesses 50, 52, 54 are used for providing substantially uniform heat transfer in the circumferential direction for minimizing any circumferential distortion of the shroud support 28 and the shroud hanger 34 due to the bleed air 60. Although in one embodiment, there may be about forty-five each of the first, second, and third recesses 50, 52, 54 in the circumferential direction, there may be as few as about eight of each of these recesses in the circumferential direction while still providing substantially uniform heat transfer around the circumference of the support and hanger flanges 30, 36.

As shown in FIGS. 1 and 2, a plurality of circumferentially spaced apart impingement holes 62 preferably extend radially inwardly through the bottom of the hanger flange 36 to between the hanger forward and aft legs 38, 40. The impingement holes 62 are also disposed in flow communication with the second recesses 52 for receiving a portion of the bleed air 60 therefrom to provide the bleed air 60 in impingement against the outer surface 42*c* of the shroud panels 42 for providing effective cooling thereof. In this exemplary embodiment, the impingement holes 62 may be used instead of and without the need for a conventional discrete impingement baffle (not shown) which would otherwise be used in conventional practice for more effectively cooling the outer surface of the shroud panels 42.

Also shown in FIG. 1, the hanger forward and aft legs 38, 40 are also preferably spaced in the middle part thereof from the shroud panels 42 to define a forward cavity or plenum 64 thereabove, and the impingement holes 62 are sized in diameter for maintaining a positive pressure backflow margin in the forward cavity 64. Positive backflow margin prevents ingestion of the hot combustion gases 16 backwardly around the shroud panels 42 and into the forward cavity 64 which would otherwise undesirably heat the components therearound.

As shown in FIG. 2 for example, an annular recessed groove or manifold 66 preferably extends completely circumferentially around the hanger flange 36 in the radially inner portion of the forward face 36*a* thereof, and radially below the second recesses 52 in flow communication therewith for receiving and circumferentially spreading the bleed air 60 therein. The perimeter of the manifold 66 abuts the aft face 30*b* of the support flange 30 to seal leakage thereat. The impingement holes 62 are disposed in direct flow communication with the bottom of the manifold 66, with the impingement holes 62 being preferably inclined axially rearwardly for directing the bleed air 60 in impingement against the aft portion of the shroud panels 42 which typically experiences high heat input. Since the shroud panels 42 as illustrated in FIG. 2 are arcuate segments collectively forming a segmented ring around the centerline axis 12, it is preferred to provide a suitable number of circumferentially spaced apart impingement holes 62 for cooling the outer surfaces of the panels 42 between the circumferential ends thereof.

The impingement holes 62 therefore extend over a greater circumferential extent than that of the individual second recesses 52. Accordingly, the annular manifold 66 is provided for receiving the bleed air 60 from the second recesses 52 and spreading the bleed air circumferentially through the manifold 66 for feeding the several spaced apart impingement holes 62 in a uniform manner without undesirable circumferential differential pressures being effected. The manifold 66 is also disposed radially below the bolt line of the several bolt holes 46 which prevents or reduces the likelihood of leakage of the bleed air from the manifold 66 through the bolt holes 46.

As shown in FIGS. 2 and 3, respective ones of the first, second, and third recesses 50, 52, 54 are preferably axially aligned together, with respective ones of the first and second metering holes 56, 58 being radially offset from each other, as shown more clearly in FIGS. 1 and 4, for dividing flow of the bleed air 60 between the second and third recesses 52, 54. The radial offset ensures that the bleed air 60 is not easily ejected straight through both flanges 30, 36 which would decrease the ability to effectively split the bleed air downwardly in the second and third recesses 52, 54. In the preferred embodiment, the first and second metering holes 56, 58 have different diameters for selectively dividing flow of the bleed air 60 between the second and third recesses 52, 54.

More specifically, bleed air channeled radially inwardly through the second recesses 52 as illustrated in FIG. 1 is channeled through the impingement holes 62 into the forward cavity 64. An aft cavity or plenum 68 is defined above the hanger aft leg 40 and below the casing 26 and is fed by the third recesses 54. By predeterminedly sizing the first and second metering holes 56, 58 and the second and third recesses 52, 54, and the impingement holes 62, the bleed air 60 may be preferentially channeled to the respective forward and aft cavities 64, 68 for optimizing clearance control performance of the turbine shroud 10 while reducing rocking tendencies of the shroud hanger 34. This ability to selectively meter the bleed air through the turbine shroud provides a "smart" turbine shroud which better utilizes the available bleed air by preferentially dividing the flow.

As shown in FIGS. 2 and 3, the first and third recesses 50, 54 are preferably circular, and the second recesses 52 are generally U-shaped with the open end of the U facing radially inwardly in direct flow communication with the outer portion of the manifold 66. These configurations provide effective radial and circumferential movement of the bleed air in the respective recesses 50, 52, 54 for effecting more uniform heat transfer in the operation of the shroud support 28 and the shroud hanger 34. Other suitable shapes for the recesses 50, 52, 54 may be used as desired.

The improved turbine shroud 10 disclosed above provides improved passive clearance control of the tip clearance C for reducing the variations thereof during the various operating modes of the gas turbine engine. The turbine shroud 10 provides Predetermined selective metering of the bleed air through the recesses 50, 52, 54 and the metering holes 56, 58, and through the impingement holes 62 which allows optimization of the bleed air flow to control the thermal response of the turbine shroud 10 relative to the thermal response of the turbine blades 22 on their disk 24. Since the potential leakage site of the bolt holes 46 is removed from the flow paths of the bleed air between and through the support and hanger flanges 30, 36, improvement in efficiency may be obtained. Since the turbine shroud 10 is more effective for matching thermal response of the shroud panels 42 relative to the blade tips 22*a*, a smaller nominal tip clearance C may be used without concern for undesirable tip rubbing, which accordingly improves the overall efficiency of the gas turbine engine by more fully utilizing compressor air for combustion and expansion through the turbines.

While there have been described herein what are considered to be preferred and exemplary embodiments of the present invention, other modifications of the invention shall be apparent to those skilled in the art from the teachings herein, and it is, therefore, desired to be secured in the appended claims all such modifications as fall within the true spirit and scope of the invention.

Accordingly, what is desired to be secured by Letters Patent of the United States is the invention as defined and differentiated in the following claims.

We claim:

1. A turbine shroud positionable radially above a plurality of turbine rotor blades for controlling tip clearance therebetween comprising:

an annular outer casing axially split at a pair of adjacent first and second radial flanges;

an annular shroud support having a radial support flange and an integral support leg at a radially inner end thereof;

an annular shroud hanger having a radial hanger flange and integral forward and aft hanger legs at a radially inner end thereof, said shroud hanger forward leg being supported on said support shroud forward leg;

a plurality of shroud panels joined to said hanger legs and having a radially inner surface positionable radially above said rotor blades to define said tip clearance therebetween;

said support flange and said hanger flange being axially positioned between said first and second casing flanges in abutting contact with each other, and said four flanges having a plurality of bolt holes arranged on a common circumferential bolt line, each bolt hole receiving a respective bolt for axially clamping together said four flanges to support said shroud panels from said casing;

said four flanges having pluralities of circumferentially spaced apart first, second, and third recesses disposed respectively between said casing first flange and said shroud flange, between said shroud flange and said hanger flange, and between said hanger flange and said casing second flange for providing radial flowpaths therebetween; and said support flange and said hanger flange having respective pluralities of circumferentially spaced apart first and second metering holes extending axially therethrough for providing flow communication between said first, second, and third recesses for channeling compressor bleed air therethrough for controlling said tip clearance.

2. A turbine shroud according to claim 1 wherein said first, second, and third recesses are spaced from said bolt holes.

3. A turbine shroud according to claim 2 wherein:

said support flange further includes a forward face disposed in abutting contact with an aft face of said casing first flange and includes said first recesses therein for providing a radial flowpath outwardly from above said support leg for channeling said compressor bleed air, and said first metering holes extend axially through said support flange in respective ones of said first recesses;

said hanger flange further includes a forward face disposed in abutting contact with an aft face of said support flange and includes said second recesses therein disposed in flow communication with respective ones of said first metering holes for providing a radial flowpath inwardly between said support flange and said hanger flange, and said second metering holes extend axially through said hanger flange in respective ones of said second recesses; and said hanger flange further includes an aft face disposed in abutting contact with a forward face of said casing second flange, and includes said third recesses therein disposed in flow communication with respective ones of said second metering holes for providing a radial flowpath inwardly between said hanger flange and said casing second flange.

4. A turbine shroud according to claim 3 wherein said first and second recesses extend radially below said casing first and second flanges, respectively, for receiving said bleed air from above said shroud support forward leg and discharging said bleed air above said hanger aft leg.

5. A turbine shroud according to claim 4 further including a plurality of circumferentially spaced apart impingement holes extending radially inwardly through said hanger flange to between said hanger forward and aft legs, and disposed in flow communication with said second recesses for providing a portion of said bleed air in impingement against an outer surface of said shroud panels.

6. A turbine shroud according to claim 5 wherein said hanger forward and aft legs are spaced in part from said shroud panels to define a forward cavity thereabove, and said impingement holes are sized for maintaining a positive pressure backflow margin therein.

7. A turbine shroud according to claim 6 further including:

an annular recessed manifold extending circumferentially around said hanger flange radially below said forward face thereof, and below said second recesses in flow communication therewith for receiving and circumferentially spreading said bleed air therein; and said impingement holes are disposed in flow communication with said manifold.

8. A turbine shroud according to claim 7 wherein respective ones of said first, second, and third recesses are axially aligned together, and said first and second metering holes are radially offset from each other for dividing flow of said bleed air between said second and third recesses.

9. A turbine shroud according to claim 7 wherein said first and second metering holes have different diameters for selectively dividing flow of said bleed air between said second and third recesses.

10. A turbine shroud according to claim 7 wherein said first and third recesses are circular, and said second recesses are generally U-shaped.

* * * * *